US006073660A

United States Patent [19]

Anthony et al.

[11] Patent Number: 6,073,660

[45] Date of Patent: Jun. 13, 2000

[54] ROTARY APPARATUS FOR DENT SPACING VARIATION FOR A LOOM REED

[75] Inventors: Richard M. Anthony, Fort Worth; Naresh Rajanna, Arlington; Brent W. Williams; James C. Walters, both of Fort Worth, all of Tex.

[73] Assignee: Williams-Pyro, Inc., Fort Worth, Tex.

[21] Appl. No.: 09/442,795

[22] Filed: Nov. 18, 1999

[51] Int. Cl.[7] ..... D03D 49/62

[52] U.S. Cl. ..... 139/192; 28/204

[58] Field of Search ..... 139/192; 28/204

[56] References Cited

U.S. PATENT DOCUMENTS

| | | | |
|---|---|---|---|
| 4,027,702 | 6/1977 | Sherrill | 139/192 |
| 4,111,240 | 9/1978 | Mallard . | |
| 4,178,970 | 12/1979 | Mueller . | |
| 4,197,881 | 4/1980 | Sage . | |
| 4,215,455 | 8/1980 | Patel | 139/192 |
| 4,844,131 | 7/1989 | Anderson et al. . | |
| 5,158,116 | 10/1992 | Kazuo et al. . | |
| 5,413,151 | 5/1995 | Moeneclaey . | |

FOREIGN PATENT DOCUMENTS

| | | |
|---|---|---|
| 59-137544 | 8/1984 | Japan . |
| 1-183557 | 7/1989 | Japan . |
| 64-40639 | 7/1989 | Japan . |

*Primary Examiner*—Andy Falik
*Attorney, Agent, or Firm*—Arthur F Zobal

[57] ABSTRACT

The reed employs two spaced apart cylinders with slots in their outer surfaces. The slots extend around the axis of each cylinder a given distance. The slots of each cylinder flare out from each other from one edge to an opposite edge. Dents are supported for movement between the two cylinders and have guides located in the slots of each cylinder. The two cylinders can be rotated together in one direction or in an opposite direction for causing the slots to move the guides and hence the dents apart or together to obtain changes in the width of the fabric along the warp direction. This change in width will cause the warp density to vary along the length of the fabric while maintaining continuous warp yarn. This feature also allows warp strands of different cross-section to be woven.

3 Claims, 8 Drawing Sheets

ROTARY APPARATUS FOR DENT SPACING VARIATION FOR A LOOM REED

BACKGROUND OF THE INVENTION

1. Field of the Invention

The invention relates to a reed for use in a loom for weaving fabric.

2. Description of the Prior Art

U.S. Pat. No. 5,158,116 discloses a reed that varies the spacing between its dents from narrow to wide during each cycle of the weaving operations. The device of this patent in one embodiment employes two plates with slots that fan out from each other to cause the spacing between the dents to increase and decrease as the reed is moved back and forth for beating purposes.

SUMMARY OF THE INVENTION

It is an object of the invention to provide a new and useful reed which employs two spaced apart cylinders with slots in their outer surfaces. The slots extend around the axis of each cylinder a given amount. The slots of each cylinder flare out from each other from one edge to an opposite edge. Dents are supported for movement between the two cylinders and have guides located in the slots of each cylinder. The two cylinders can be rotated together in one direction or in an opposite direction for causing the slots to move the guides and hence the dents apart or together to obtain changes in the width of the fabric along the warp direction. This change in width will cause the warp density to vary along the length of the fabric while maintaining continuos warp yarn. This feature also allows warp strands of different cross-section to be woven.

DESCRIPTION OF THE PREFERRED EMBODIMENTS

Figure 1:
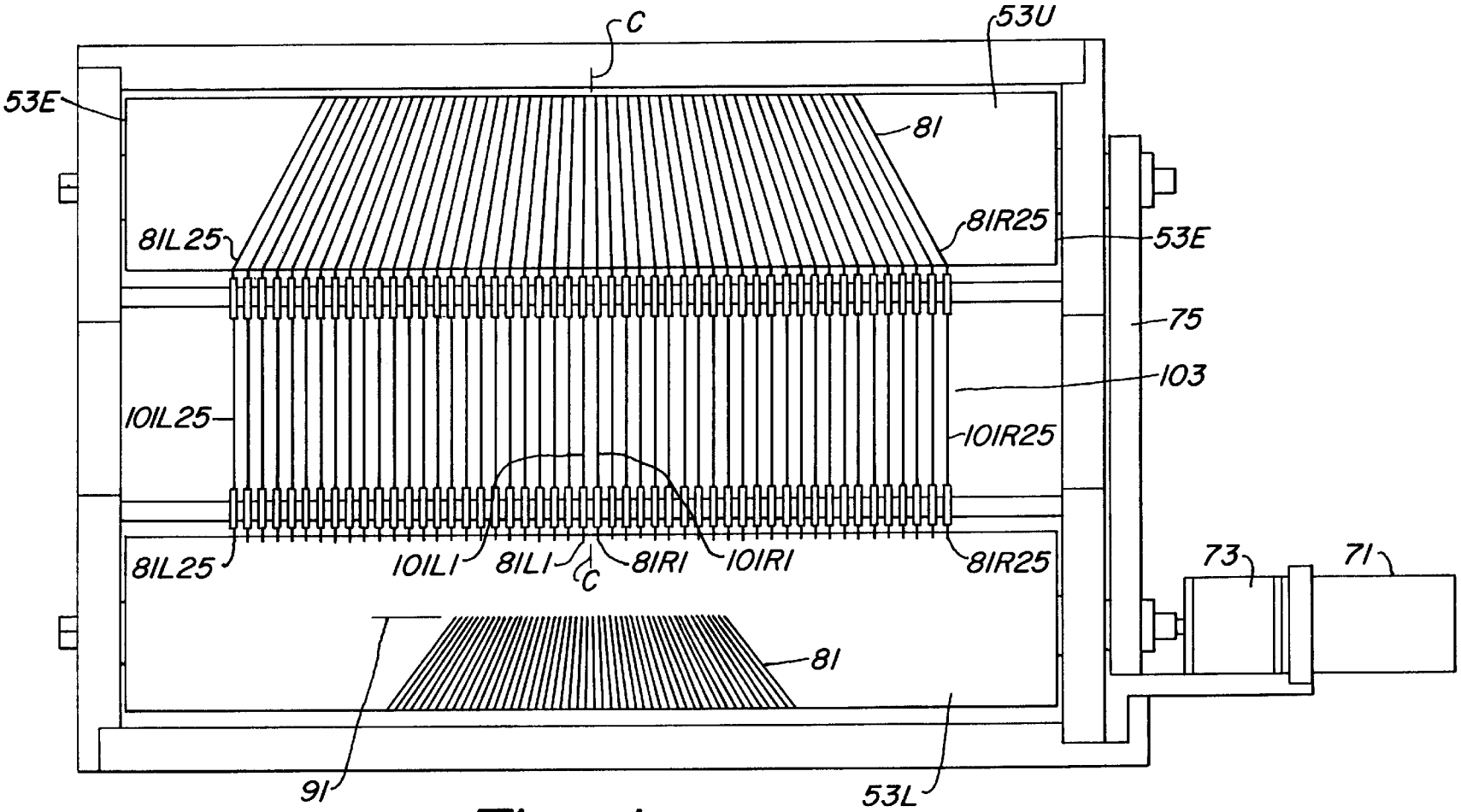
FIG. 1 is a plan view of the reed of the invention with its cylinders in rotary positions to obtain the maximum spacing between adjacent dents.
Figure 2:
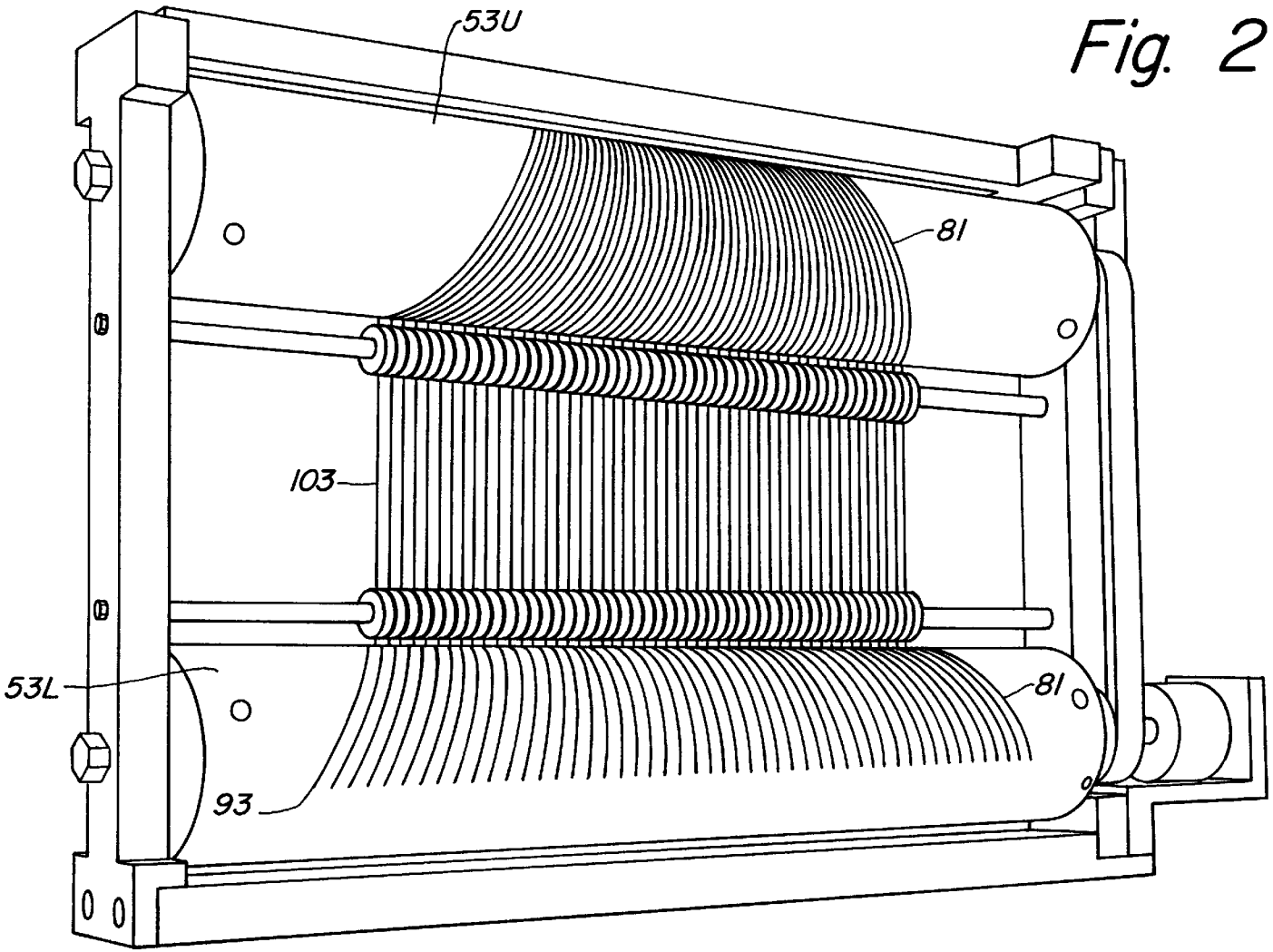
FIG. 2 is a perspective view of the reed of FIG. 1 with its cylinders in rotary positions to obtain a spacing between adjacent dents which is between the maximum and minimum obtainable.
Figure 3:
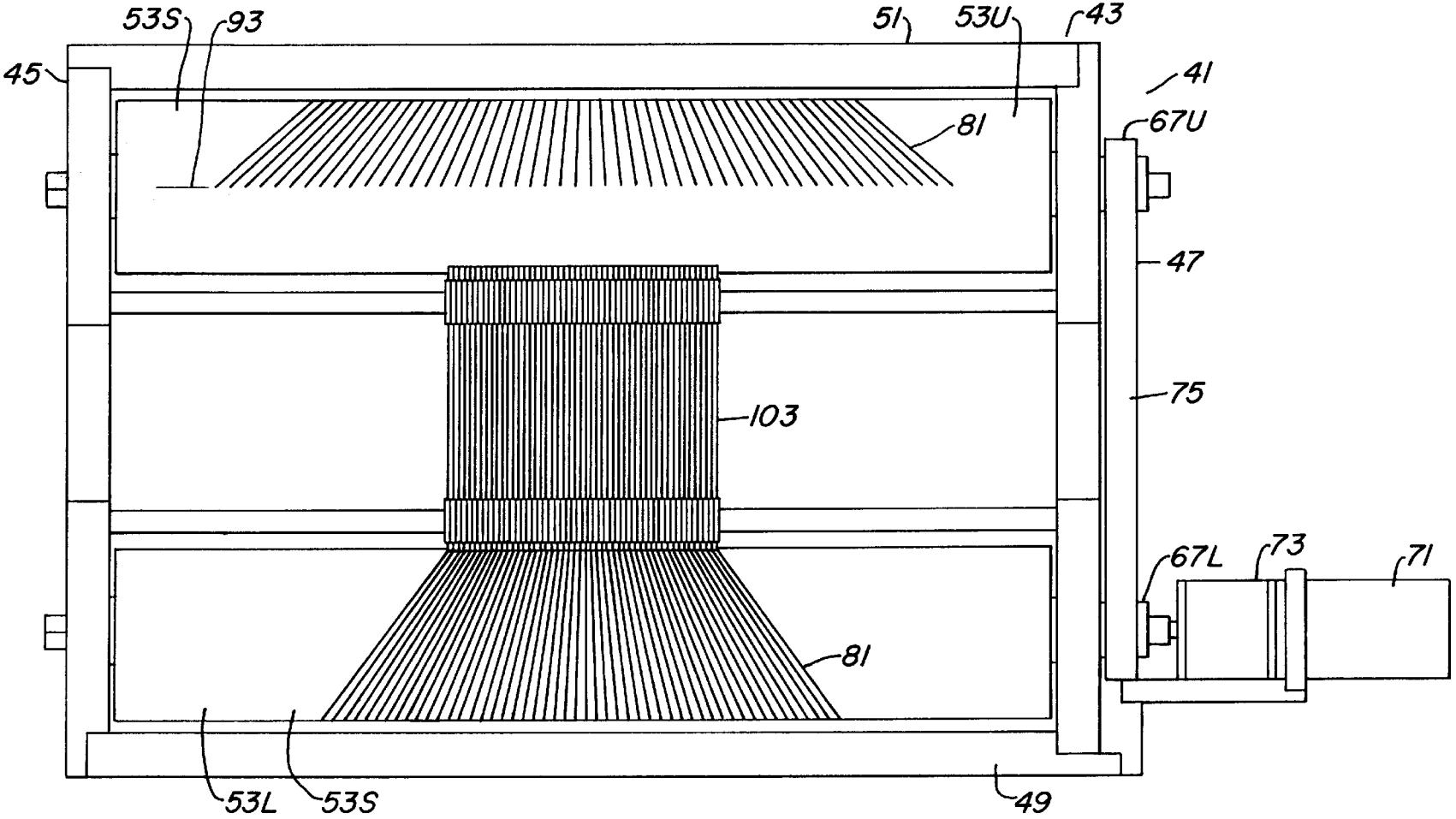
FIG. 3 is a plan view of the reed of the invention with its cylinders in rotary positions to obtain the minimum spacing between adjacent dents.
Figure 4:
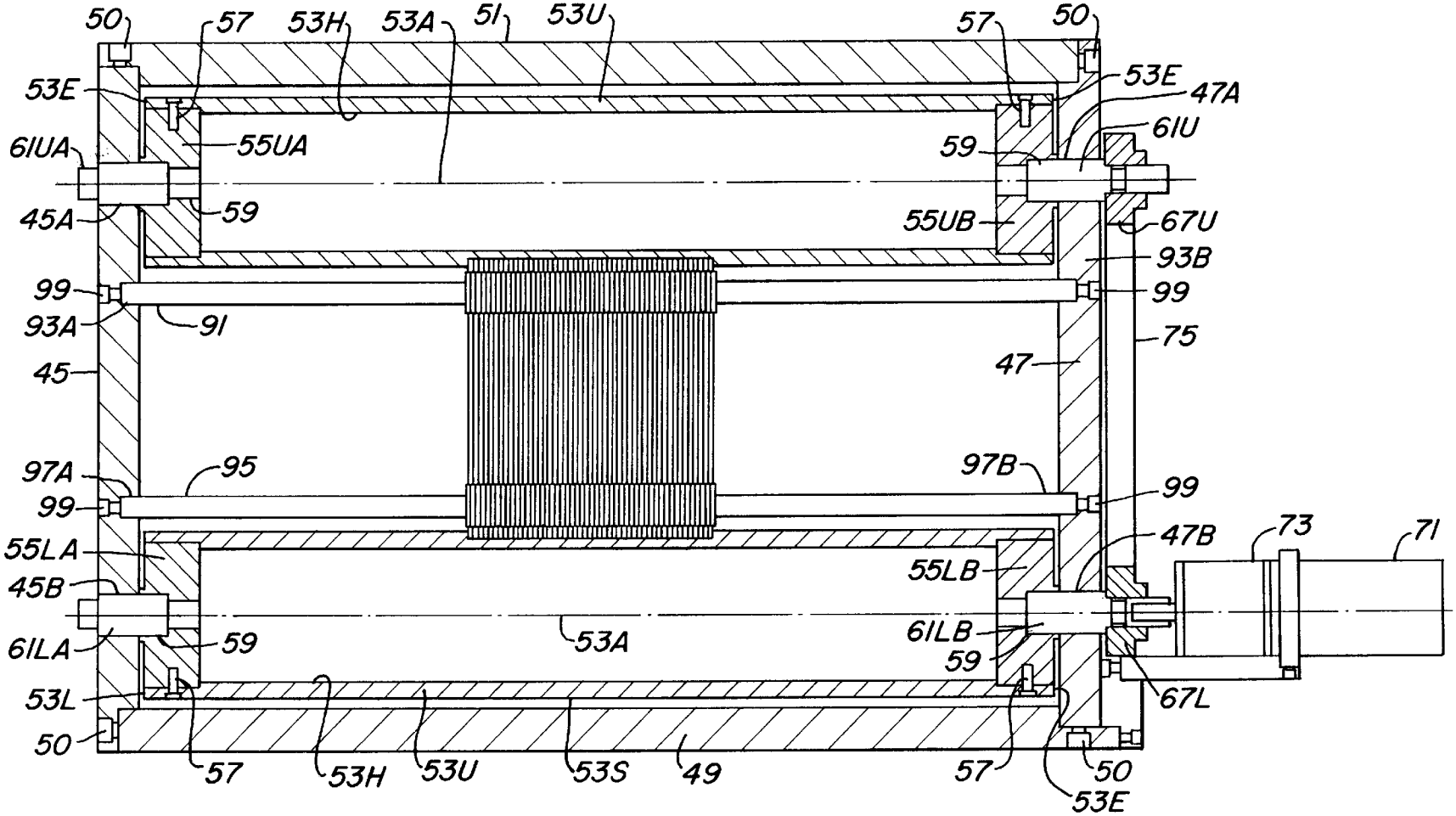
FIG. 4 is a partial cross-section of the reed of the invention.
Figure 5:
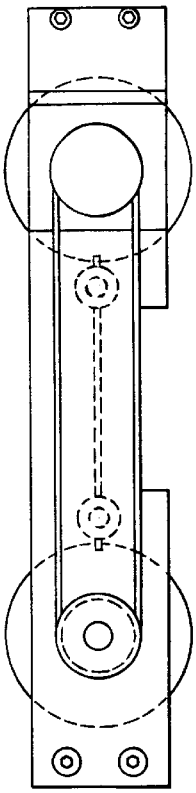
FIG. 5 is a right side view of FIGS. 1, 3, and 4.

Referring now to FIGS. 1–3 of the drawings, the reed of the invention is identified at 41. It comprises a frame 43 formed of two side frame members 45 and 47, a lower frame member 49 and an upper frame member 51. Supported for rotation within the frame 41 are two spaced apart upper and lower cylinders 53U and 53L. Referring also to FIG. 4, the two cylinders are identical and each has an outer cylindrical surface 53S with a central axis 53A and a central apertures 53H extending therethrough between its ends 53E. Each cylinder has a plurality of slots 81 formed in its outer surface. The number of slots 81 formed in the outer surface of cylinder 53U is equal to the number of slots 81 formed in the outer surface of cylinder 53L. The slots 81 extend about 270° around the axis of the cylinder and start along a first line 91 parallel with the axis 53A and fan outward and end along a second line 93 parallel with the axis 53A. Each slot is located in a given plane passing through the cylinder. From line 91 to line 93 the distance between adjacent slots 81 gradually increases.

Secured to each end 53E of each of the cylinders 53U and 53L within its central aperture 53H is an end plate. The end plates are identified at 55UA, 55LA and 55UB, 55LB. The end plates are secured in place by way of screws 57. Formed through each end plate is a central aperture 59 in which is lightly located a rod or arbor such that rotation of the arbors causes the cylinders 53U and 53L to rotate. The arbors are identified at 61UA, 61LA, and 61UB, 61LB. The arbors extend through apertures 45A, 45B and 47A, 47B of frame members 45 and 47. Sprockets 67U and 67L are secured to arbors 61UB and 61LB. A reversible motor 71 and a gear 73 are coupled to the sprocket 67L for rotating the sprocket in either a clockwise or counter-clockwise direction. A notched belt 75 is coupled around the sprockets 67U and 67L such that rotation of sprocket 67L and hence the cylinder 53L causes the sprocket 67U and hence the cylinder 53U to be rotated in the same direction with both cylinders being rotated together in synchronism with each other. Thus the motor 71 can rotate both cylinders together in a clockwise or counter clockwise direction.

Secured to the frame members 45 and 47 are two cylindrical rods 91 and 95. As shown in FIG. 4, the ends of rod 91 are located in apertures 93A and 93B formed through frame members 45 and 47 and the ends of rod 95 are located in apertures 97A and 97B formed through frame members 45 and 47. The rods 91 and 95 are secured in place to the frame members 45 and 47 by bolts 99.

Figure 6:
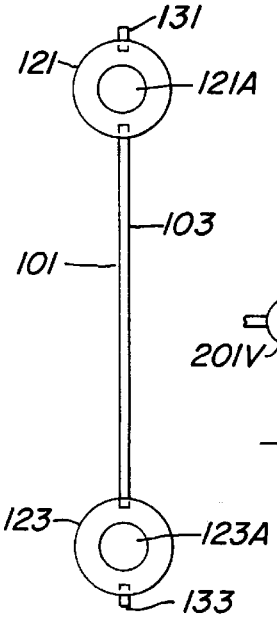
FIG. 6 is a side view of one of the dents of the reed.

Slidably coupled to the rods 91 and 95 are plurality of dent members 101. The number of dent members 101 is equal to the number of slots 81 of each of the cylinders. Referring to FIG. 6, each dent member 101 comprises a metal rod 103 having opposite ends fixedly connected to metal rings 121 an 123 with each metal ring having a central aperture 121A and 123A for receiving the rods 91 and 95 respectively such that the rings 121 an 123 and hence the rod 103 may slide on the rods 91 and 95 either to the left or to the right as shown in FIGS. 1, 3, and 4.

Fixedly connected to the top and bottom of the rings 121 and 125 are two short metal rod members 131 and 133 having outside diameters sufficient to slidably fit in one slot 81 of cylinder 53U and in one slot 81 of cylinder 53L. As mentioned above, the number of dent members 101 is equal to the number of slots 81 of each of the two cylinders 53U and 53L. In one embodiment, there are fifty dents 101 and fifty slots 81 formed in the outer surfaces of each of cylinders 53U and 53L.

Figure 9:
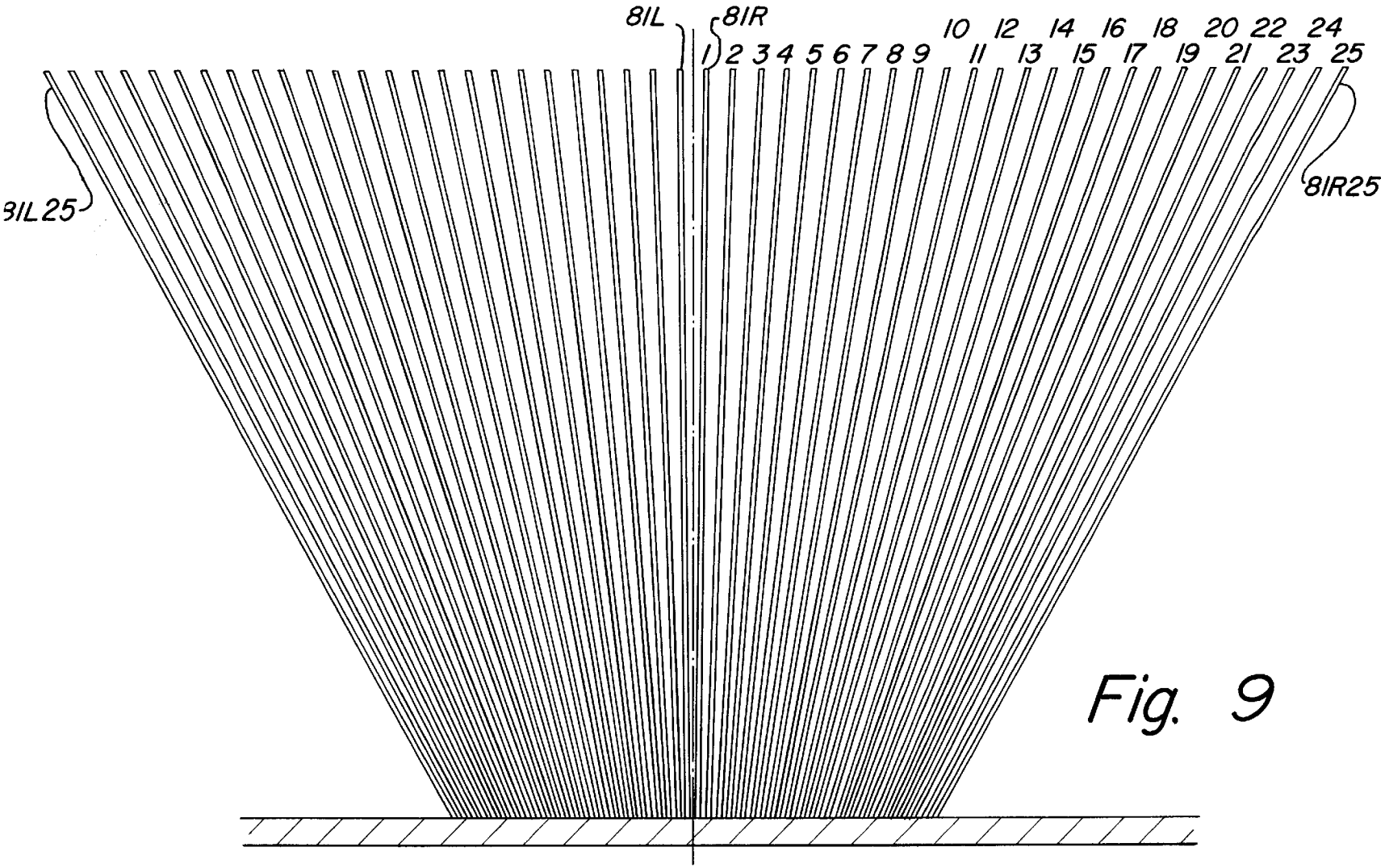
FIG. 9 depicts the slots of each of the cylinders as they would appear if they extended in straight lines.

Referring to FIG. 9, there are twenty five dents 101 to the right of the center line C and twenty five dents 101 to the left of the center line C. The dents on the right side of the center line C are identified as 101R1, to 101R25 respectively and the dents on the left side of the center line C are identified as 101L1 to 101L25 respectively. For each of cylinders 53U and 53L, there are twenty five slots 81 to the right of the center line C and twenty five slots 81 to the left of the center line C. The slots on each of cylinders 53U and 53L on the right side of the center line C are identified as 81R, to 81R25 respectively and the slots on the left side of the center line C are identified as 81L1 to 81L25 respectively. The guides 131 of dents 101R1 to 101R25 slidably fit in slots 81R1 to 81R25 of cylinder 53U and the guides 131 of dents 101L1 to 101L25 slidably fit in slots 81L1 to 81L25 of cylinder 53U. The guides 133 of the dents **101*r*1 to 101R25 slidably fit in slots 81R1 to 81R25 of cylinder 53L and the guides 133 of dents 101L1 to 101L25 slidably fit in slots 81L1 to 81L25 of cylinder 53L**.

Figure 8:
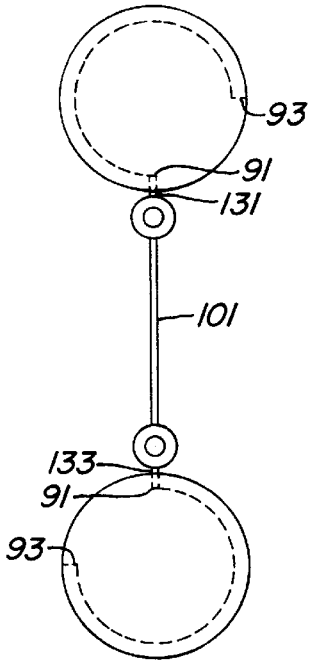
FIGS. 7 and 8 schematically illustrate the cylinders of the reed in the position of FIGS. 1 and 3 respectively.
Figure 7:
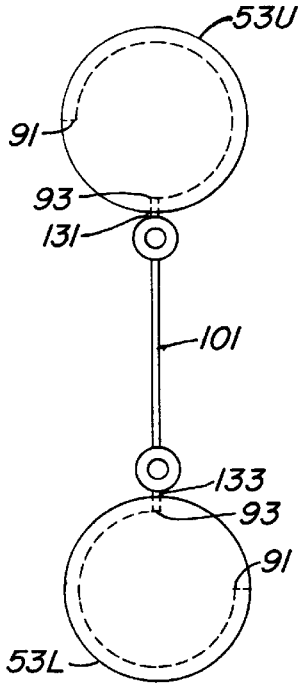

Referring to FIGS. 1–3, 7 and 8, when the cylinders 53U and 53L are in rotary positions to achieve maximum spacing between the dents 101 as seen in FIGS. 1 and 7, the guides 131 and 133 of the dents are located in the two groups of slots 81 at their ends at the expanded edges of the two groups of slots along lines 93 as shown in FIGS. 1 and 7. By rotating the cylinders 53U and 53L together clockwise as seen in FIG. 7 to the positions as shown in FIGS. 8 and 3, the group of slots 81 of cylinder 53U cause the guides 131 to move closer together and the group of slots 81 of cylinder 53L cause the guides 133 to move closer together such that the guides 131 and 133 and hence the dents 101 are located at the edges of the two groups of slots 81 along lines 91 of cylinders 53U and 53L. Thus the minimum spacing between the adjacent dents 101 is achieved.

In summary, by rotating the cylinders 53U and 53L together counter clockwise, from the positions shown in FIG. 8, the spacing between adjacent dents 101 is increased. By rotating the cylinders 53U and 53L clockwise from the positions shown in FIG. 7, the spacing between adjacent dents 101 is decreased.

In order to weave a sheet of material of a given width, the motor 71 will be operated to rotate the cylinders 53U and 53L together in the desired direction to achieve the desired spacing between adjacent dents 103 depending on the cross-sectional size of the wrap strands of material to be woven or the density desired of the fabric being woven along the warp direction. In addition, by spreading the dents apart the angle of the undulations of the weft strands may be decreased. At the desired dent spacing, rotation of the motor 71 may be terminated to allow weaving to be carried out. In another embodiment, adjustment of the spacing between the dents may be carried out continuously, for example, during a certain period of time during a weaving operation by operation of the motor 71 while the loom is operating and hence while weaving is carried out. This allows changes in the width of the fabric along the warp direction to be achieved. This change in width will cause the warp density to be varied along the length of the warp while maintaining continuous warp yarn while the loom is operating and hence while weaving is carried out.

Figure 11:
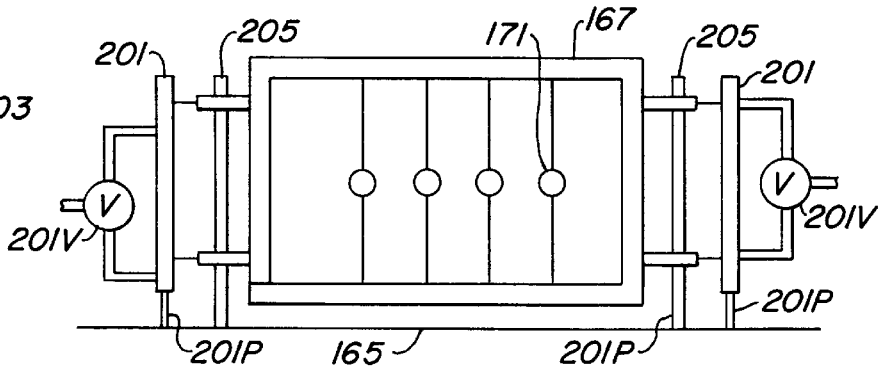
FIG. 11 illustrates one of the harnesses of the loom of FIG. 10.
Figure 10:
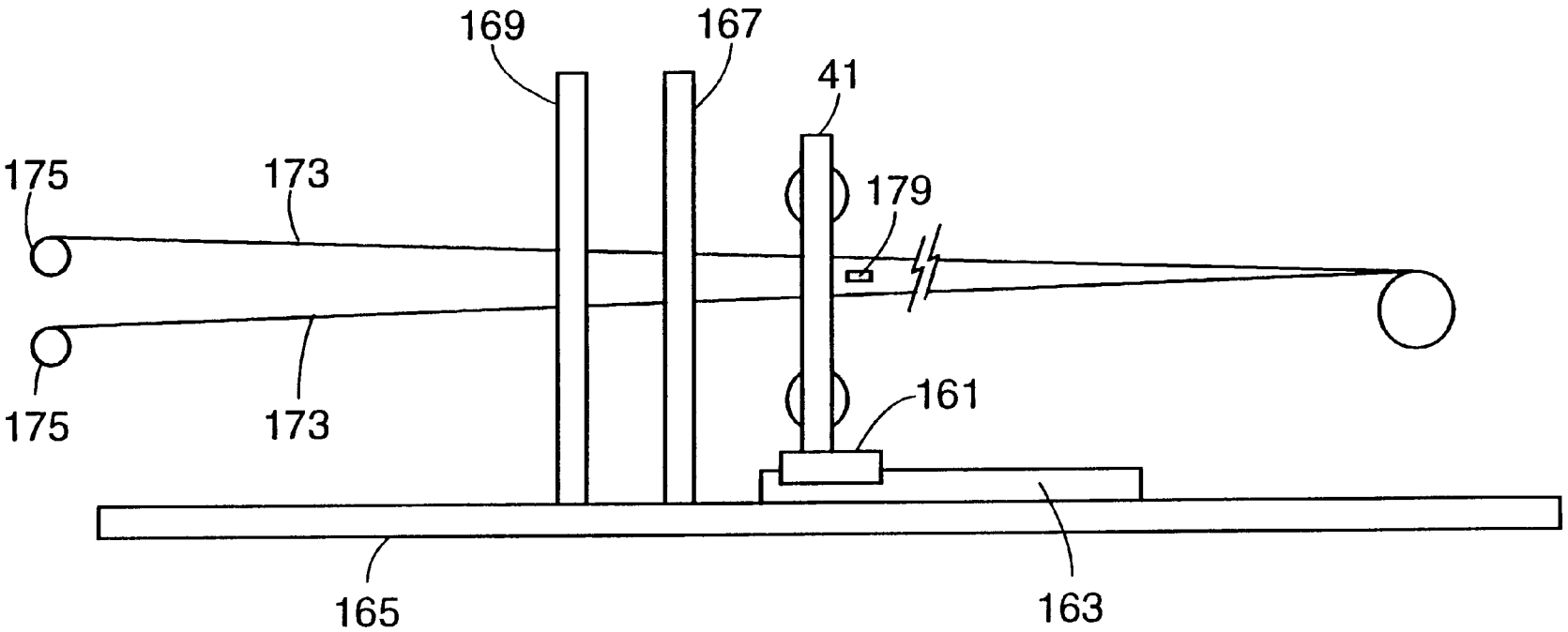
FIG. 10 is schematic side view of a loom employing the reed of the invention.
Figure 12:
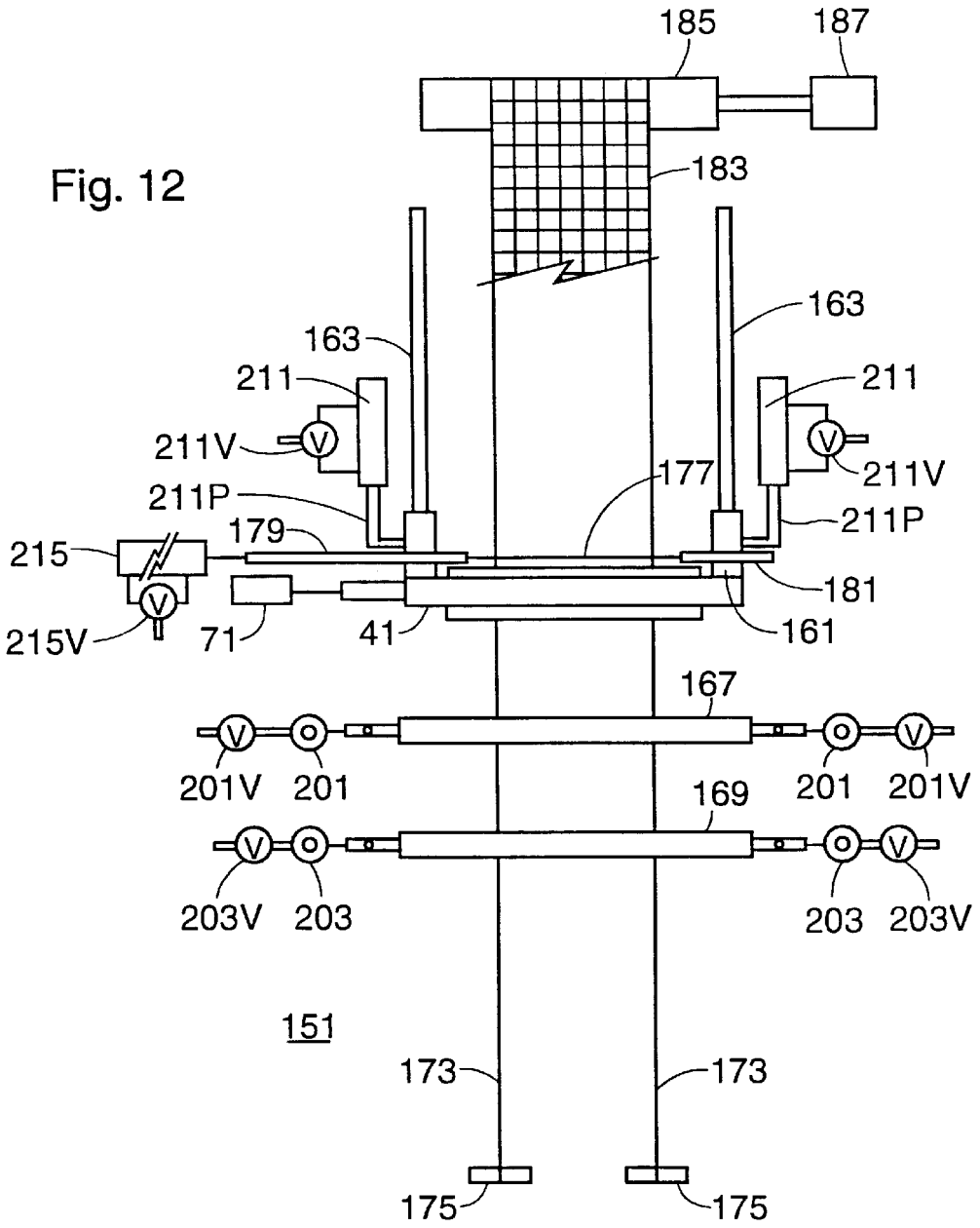
FIG. 12 is a top plan view of FIG. 10.
Figure 13:
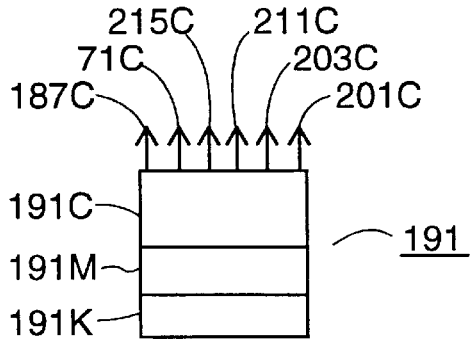
FIG. 13 illustrates a control system for controlling the loom.

Referring to FIGS. 10–12, the reed 41 is mounted on sliders 161 which are mounted on rails 163 which are mounted on a base 165 such that the reed 41 may be used for beating purposes in the loom 151.

Members 167 and 169 are harnesses each having a plurality of heddles 171 to guide the warp strands two of which are illustrated at 173 which are fed from spools 175. The warp strands 173 pass between adjacent dents 103. Weft strands 177 are fed from a roll (not shown) between the warp strands 173 by a rapier 179 to a mechanism 181 to weave a sheet 183 of material which is wound around a take up reel 185 operated by a motor 187. In a cycle of the weaving operations, the motor 187 rotates the take up reel 185. One of the harnesses 167, 169 is lifted; the rapier 179 is moved between the warp strands 173 to place a weft strand 177 therebetween and then the rapier is moved back; and the reed 41 is moved forward and then rearward for beating purposes.

A computer 191 comprising a keyboard 191K, a monitor 191M and a CPU 191C is used to control the operations of the loom 151. Pneumatic cylinders 201 and 203 controlled by electrically actuated valves 201V and 203V are used to move the harnesses a 167 and 169 alternately up and then down during sequential cycles. Each harness can slide up and down two rods 205 secured to the base 165. The cylinders 201 of harness 167 are connected to the harness 167 and their pistons 201P bear against the base 165. The harness 167 can be raised and lowered by controlling air to the cylinders 201 by way of the valves 201V. The harness 169 is constructed in the same manner as harness 167 and is moved upward and downward in the same manner by operating the valves 203V to control the cylinders 203.

The sliders 161 are controlled by pneumatic cylinders 211 having their pistons 211P connected to the sliders 161. The cylinders 211 are controlled by electrically actuated valves 211V which control air flow to the cylinders 211 to cause the sliders 161 and hence the reed to move forward and then rearward for beating purposes.

The rapier 179 is controlled by a pneumatic cylinder 215 to move its piston outward and then inward to move the rapier between the warps 173 and then back.

The computer 191 has leads 201C, 203C, 211C, 215C, 71C and 187C for controlling the valves 201V, 203V, 211V and 215V and the motors 71 and 187 respectively.

In one embodiment, each of the cylinders 53U and 53L has a length of 22.0 inches and a diameter of 4.0 inches. Fifty slots 81 are formed in the outside surface of each cylinder. Along the line 91 adjacent slots 81 are spaced apart 0.125 inches. Along the line 93 adjacent slots 81 are spaced apart 0.353 inches. This reed is useful in weaving material from composites such as e-glass, s-glass, carbon fibers, and KEVLAR. It is to be understood that the above specifications and dimensions may be varied.

What is claimed is:

1. A reed for use in a loom for weaving material from strands of material, comprising:

a frame comprising two spaced apart frame members, spaced apart first and second cylinders supported for rotation between said two frame members, spaced apart first and second guide members coupled to said two frame members between said first and second cylinders, each of said cylinders comprising a central axis and an exterior surface, means for rotating said first and second cylinders together in a first direction and in a second opposite direction, a plurality of dent means having first and second ends supported by said first and second guide members respectively for movement along said guide members, a plurality of spaced apart slots formed in said exterior surface of each of said cylinders, each of said plurality of slots of each of said cylinders has first and second ends which are angularly spaced apart about said axis of said cylinders with adjacent ones of said second ends of said slots being spaced further apart from each other than adjacent ones of said first ends of said slots, first and second guide means coupled to said first and second ends of each of said dent means respectively with said first and second guide means being located in first and second generally straight lines generally parallel to each other, said first and second guide means of each of said dent means being located in one of said slots of said first cylinder and in one said slots of said second cylinder respectively such that rotation of said first and second cylinders together in said first and second directions cause said dent strands to move apart and together respectively.

2. A reed for use in a loom for weaving material from strands of material comprising:

a frame comprising two spaced apart frame members, spaced apart upper and lower cylinders supported for rotation between said two frame members, spaced apart upper and lower guide members coupled to said two frame members between said upper and lower cylinders, each of said cylinders comprising a central axis and an exterior surface, means for rotating said upper and lower cylinders together in a first direction and in a second opposite direction, a plurality of dent means having upper and lower ends supported by said upper and lower guide members respectively for movement along said guide members, a plurality of spaced apart slots formed in said exterior surface of each of said cylinders, each of said plurality of slots of each of said cylinders has first ends which are located along a first line which is parallel to said axis of its said cylinder and second ends which are located along a second line which is parallel to its said cylinder and angularly spaced from said first line, each of said slots of each of said cylinders is located in a given plane such that adjacent slots at said second line are spaced further apart from each other than at said first line, upper and lower guide means coupled to said upper and lower ends of each of said dent means respectively, said upper and lower guide means of each of said dent means being located in one of said slots of said upper cylinder and in one said slots of said lower cylinder respectively such that rotation of said upper and lower cylinders together in said first and second directions cause said dent strands to move apart and together respectively.

3. The reed of claim 2, wherein:

all of said upper guide means are located generally in an upper straight line and all of said lower guide means are located generally in a lower straight line generally parallel to said first straight line.

* * * * *